US008225751B2

(12) United States Patent
Kisaichi et al.

(10) Patent No.: US 8,225,751 B2
(45) Date of Patent: Jul. 24, 2012

(54) COOLING WATER PASSAGE STRUCTURE FOR ENGINE

(75) Inventors: Toru Kisaichi, Tokyo (JP); Tomokazu Nomura, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 790 days.

(21) Appl. No.: 12/328,311

(22) Filed: Dec. 4, 2008

(65) Prior Publication Data

US 2009/0151662 A1 Jun. 18, 2009

(30) Foreign Application Priority Data

Dec. 13, 2007 (JP) ..... 2007-322380

(51) Int. Cl.
*F02F 1/10* (2006.01)

(52) U.S. Cl. ..... 123/41.72; 123/41.1; 123/41.01

(58) Field of Classification Search ..... 123/41.01, 123/41.1, 41.44, 41.24, 41.72, 41.74, 41.79, 123/41.81, 41.82 R, 41.82 A
See application file for complete search history.

(56) References Cited

U.S. PATENT DOCUMENTS 2,871,836 A 2/1959 Doughty
5,111,774 A * 5/1992 Hiramoto et al. ..... 123/41.1
5,131,357 A * 7/1992 Inoue et al. ..... 123/41.74
5,279,265 A * 1/1994 Matsuo et al. ..... 123/41.44
6,125,811 A * 10/2000 Koriyama et al. ..... 123/195 R
6,843,209 B2 * 1/2005 Miyagawa et al. ..... 123/41.1
6,978,742 B2 * 12/2005 Miyagawa et al. ..... 123/41.1
2002/0195289 A1 12/2002 Schneider et al.

FOREIGN PATENT DOCUMENTS

EP 0 933 510 A2 8/1999
GB 2 249 347 A 5/1992
JP 2-139325 U 11/1990

OTHER PUBLICATIONS

European Search Report dated Dec. 4, 2008, issued in corresponding European Patent Application No. 08018406.2.

* cited by examiner

*Primary Examiner* — Noah Kamen
*Assistant Examiner* — Long T Tran
(74) *Attorney, Agent, or Firm* — Westerman, Hattori, Daniels & Adrian, LLP

(57) ABSTRACT

A cooling water passage structure includes an engine having cylinder axes arranged in a V-shape centering on a crankshaft; water jackets formed in front and rear cylinder blocks and cylinder heads of the engine; a thermostat case having a portion formed integrally with the front and rear cylinder blocks in the V-bank of the front and rear cylinder blocks; a cooling water inlet side connecting portion 81 connecting a cooling water supply side line with a cooling water passage including the water jackets; and a cooling water outlet side connecting portion connecting a cooling water discharge side line with a cooling water passage including the water jackets. The thermostat case, the cooling water inlet side connecting portion, and the cooling water outlet side connecting portion are disposed at one end side of the engine in the direction of the crankshaft 52.

5 Claims, 12 Drawing Sheets

COOLING WATER PASSAGE STRUCTURE FOR ENGINE

TECHNICAL FIELD

The present invention relates generally to a cooling water passage structure for an engine, and particularly for an engine mounted on a motorcycle.

BACKGROUND OF THE INVENTION

In related art, there is known a cooling water passage structure for an engine as below. This structure includes cylinders arranged in a V-shape and a cylinder block having a water jacket surrounding the cylinders. A thermostat chamber is concavely provided in a valley portion in the upper surface of the cylinder block. An impeller chamber of a water pump is concavely provided at an end face of the cylinder block. A suction water passage connecting a bottom of the thermostat chamber with the impeller chamber, a cooling water passage connecting a water pump outlet with the water jacket, and a bypass hole communicating from the thermostat chamber to the outside are provided inside the wall body of the cylinder block. A warm water tube communicating from the water jacket to a radiator and a cooling water tube communicating from the radiator to the thermostat chamber are provided outside the cylinder head. (See e.g. Japanese Utility Model Laid-open No. Hei 2-139325.)

SUMMARY OF THE INVENTION

Incidentally, in the engine cooling water passage structure described in Japanese Utility Model Laid-open No. Hei 2-139325, the thermostat case is formed within the V-bank of the cylinder block. Since the cooling water line is complicatedly arranged to extend in the narrow space within the V-bank, it is difficult to improve the productivity of the engine. It is needed to simplify the cooling water passage structure.

In view of the foregoing, it is an object of the present invention to provide a cooling water passage structure for an engine that can be simplified and improve the productivity of the engine.

To achieve the above problem, a first aspect of the invention is a cooling water passage structure for an engine, including: an engine having cylinder axes arranged in a V-shape centering on a crankshaft; water jackets formed in respective cylinder blocks and respective cylinder heads of the engine; a thermostat case having a portion formed integrally with the cylinder blocks in the V-bank of the cylinder blocks; a cooling water inlet side connecting portion connecting a cooling water supply side line with a cooling water passage including the water jackets; and a cooling water outlet side connecting portion connecting a cooling water discharge side line with a cooling water passage including the water jackets; and characterized in that the thermostat case, the cooling water inlet side connecting portion, and the cooling water outlet side connecting portion are disposed on one side of the engine in the axial direction of the crankshaft.

A second aspect of the invention is characterized in that, in addition to the configuration of the first aspect of the invention, the cooling water inlet side connecting portion and the cooling water outlet side connecting portion are arranged on a centerline to align with each other as viewed from the axial direction of the crankshaft, the centerline dividing the V-bank of the cylinder blocks in two.

A third aspect of the invention is characterized by, in addition to the configuration of the first aspect of the invention, further including a cooling water discharge passage adapted to discharge cooling water from the water jackets to the thermostat case and characterized in that the cooling water discharge passage is formed in the cylinder heads to extend in a direction perpendicular to the crankshaft; and characterized in that the cooling water discharge passage and the thermostat case are arranged in a direction perpendicular to the crankshaft so as to align with each other.

A fourth aspect of the invention is characterized by, in addition to the configuration of the invention recited in claim 1, further including a bypass line connected to an end of the thermostat case opposite the crankshaft with respect to the thermostat case and characterized in that the bypass line extends toward one side of the engine in the direction of the crankshaft, and connects with a water pump.

A fifth aspect of the invention is characterized by, in addition to the configuration of the first aspect of the invention, further including a cooling water supply passage adapted to supply cooling water from the cooling water inlet side connecting portion to the water jackets, and characterized in that the cooling water supply passage is forms a protrusion on the cylinder block, and the protrusion includes an engine hanger used to secure the engine to a body frame.

A sixth aspect of the invention is characterized in that, in addition to the configuration of the first aspect of the invention, the cooling water discharge passage is formed in a V-shape as viewed from the direction of the crankshaft and the thermostat case is disposed at a central portion of the V-shape, a temperature sensor constituting a thermostat is disposed in the V-bank formed by the cooling water discharge passage, a bypass passage connecting portion is formed on the downstream side of the temperature sensor, and the cooling water discharge side connecting portion is formed in the vicinity of the top of the V-bank formed by the cooling water discharge passage.

According to the cooling water passage structure for an engine according to the first aspect of the invention, the thermostat case, the cooling water inlet side connecting portion, and the cooling water outlet side connecting portion are disposed on one side of the engine in the axial direction of the crankshaft. The cooling water line is not arranged to extend in the narrow space in the V-bank. Thus, the cooling water passage structure can be simplified to improve the productivity of the engine. In addition, the space for arranging auxiliary devices therein can be ensured in the V-bank.

According to the cooling water passage structure for an engine according to the second aspect of the invention, the cooling water inlet side connecting portion and the cooling water outlet side connecting portion are arranged on a centerline to align with each other as viewed from the axial direction of the crankshaft, the centerline dividing the V-bank of the cylinder blocks in two. Thus, the V-bank shape of the cylinder block can effectively be utilized to make the engine compact.

According to the cooling water passage structure for an engine according to the third aspect of the invention, a cooling water discharge passage adapted to discharge cooling water from the water jackets to the thermostat case is provided and the cooling water discharge passage is formed in the cylinder heads to extend in a direction perpendicular to the crankshaft, and the cooling water discharge passage and the thermostat case are arranged in a direction perpendicular to the crankshaft so as to align with each other. The partition wall between the cooling water discharge passage and the thermostat case can be shared with each other. Thus, the thickness of the partition wall can be reduced compared with the case where the partition wall is formed individually, thereby reducing the weight of the engine. In addition, the cooling water discharge passage and the thermostat case are formed to connect the V-arranged cylinder blocks and the thermostat case with each other in the back and forth direction of the vehicle. Thus, the rigidity of the cylinder blocks can be improved.

According to the cooling water passage structure for an engine according to the fourth aspect of the invention, the bypass line is provided which is connected to an end of the thermostat case opposite from the crankshaft with respect to the thermostat case, and the bypass line extends toward one side of the engine in the axial direction of the crankshaft and connects with a water pump. Thus, all the cooling water lines can be put together on one side of the engine, so that it is easy to check the cooling water lines. In addition, the space in the V-bank can be ensured.

According to the cooling water passage structure for an engine according to the fifth aspect of the invention, the cooling water supply passage is provided which is adapted to supply cooling water from the cooling water inlet side connecting portion to the water jackets, the cooling water supply passage is forms the protrusion on the cylinder block, and the protrusion includes an engine hanger used to secure the engine to a body frame. Thus, the protrusion is effectively be utilized to form the engine hanger, thereby reducing the size of the engine.

According to the cooling water passage structure for an engine according to the sixth aspect of the invention, during warm-up operation, the cooling water flowing toward the bypass line flows through the temperature sensor and the temperature sensor is disposed near a position where the direction of the flow of the cooling water from the water jackets is changed. Thus, the temperature of the cooling water can efficiently be transmitted to the temperature sensor, thereby enhancing the response of the temperature. At the time of completing the warm-up operation, the cooling water increased in flow rate after the warm-up operation can be led to the cooling water outlet side connecting portion in the form conforming to the direction of the flow thereof because the cooling water outlet side connecting portion is formed in the vicinity of the top of the V-bank formed by the cooling water discharge passages. Thus, pressure loss can be reduced to improve the efficiency of the water pump.

BRIEF DESCRIPTION OF THE DRAWINGS

The advantages of the invention will become apparent in the following description taken in conjunction with the drawings, wherein.

DETAILED DESCRIPTION OF THE INVENTION

An embodiment of a cooling water passage structure for an engine according to the present invention will hereinafter be described in detail with reference to the accompanying drawings. It is to be noted that the drawings shall be viewed based on the orientation of referential symbols.

In the following description the front and back or rear, the left and right, the upside and downside are based on the direction a rider looks and the front is indicated with Fr, the rear Rr, the left side L, the right side R, the upside U and the downside D.

Figure 1:
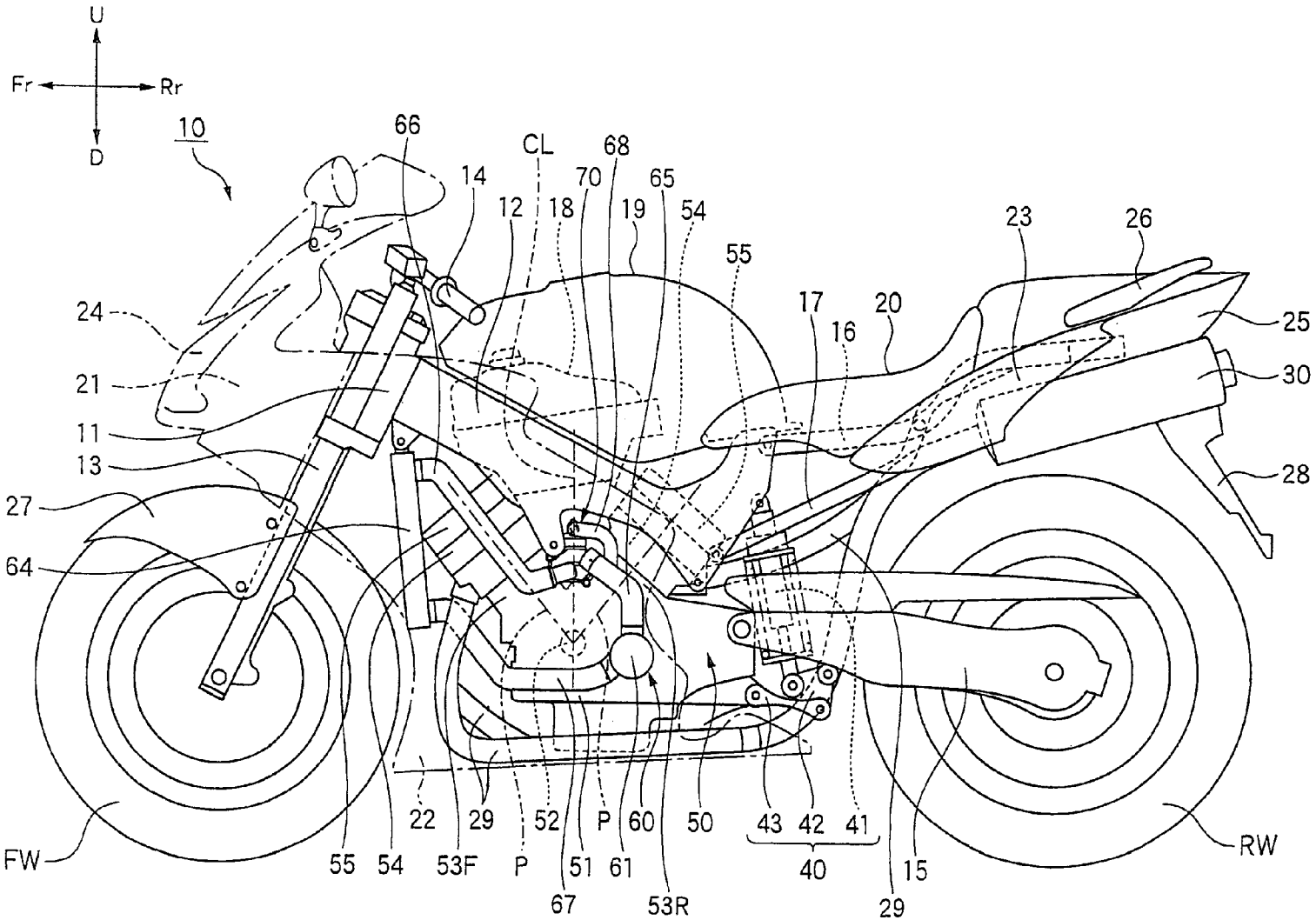
FIG. 1 is a lateral view illustrating the entire configuration of a motorcycle on which a cooling water passage structure for an engine according to the present invention is mounted.

With reference to FIG. 1, a motorcycle 10 of the present embodiment includes a pair of left and right main frames 12 extending rearward and downward from a head pipe 11; a front fork 13 turnably supported by the head pipe 11; a front wheel FW rotatably supported by the lower end of the front fork 13; and steering handlebars 14 mounted to the upper end of the front fork 13. The motorcycle 10 further includes a V-type engine 50 mounted to the lower portion of the main frames 12; a swing arm 15 swingably supported by the rear portion of the engine 50; a rear wheel RW rotatably supported by the rear end of the swing arm 15; and a rear suspension 40 swingably connecting the rear portion of the main frames 12 with the lower portion of the swing arm 15. The motorcycle 10 further includes seat frames 16 joined to the rear upper portions of the main frames 12 and extending rearward and upward; sub frames 17 joined to the rear lower portions of the main frames 12, extending rearward and upward, and joined to the seat frames 16 at intermediate portions and at rear portions; an air cleaner box 18 and a fuel tank 19 mounted inside the main frames 12; and a seat 20 mounted on the seat frames 16.

In FIG. 1, reference numeral 21 denotes a front cowl, 22 a side cowl, 23 a rear cowl, 24 a headlamp, 25 a tail lamp, 26 a grab rail, 27 a front fender, 28 a rear fender, 29 an exhaust pipe, and 30 a muffler.

The rear suspension 40 includes a suspension unit 41 swingably mounted to the rear portion of the main frames 12; a generally triangular first link 42 swingably connecting the lower end of the suspension unit 41 with the lower intermediate portion of the swing arm 15; and a second link 43 swingably connecting the first link 42 with the rear portion of the engine 50.

Figure 2:
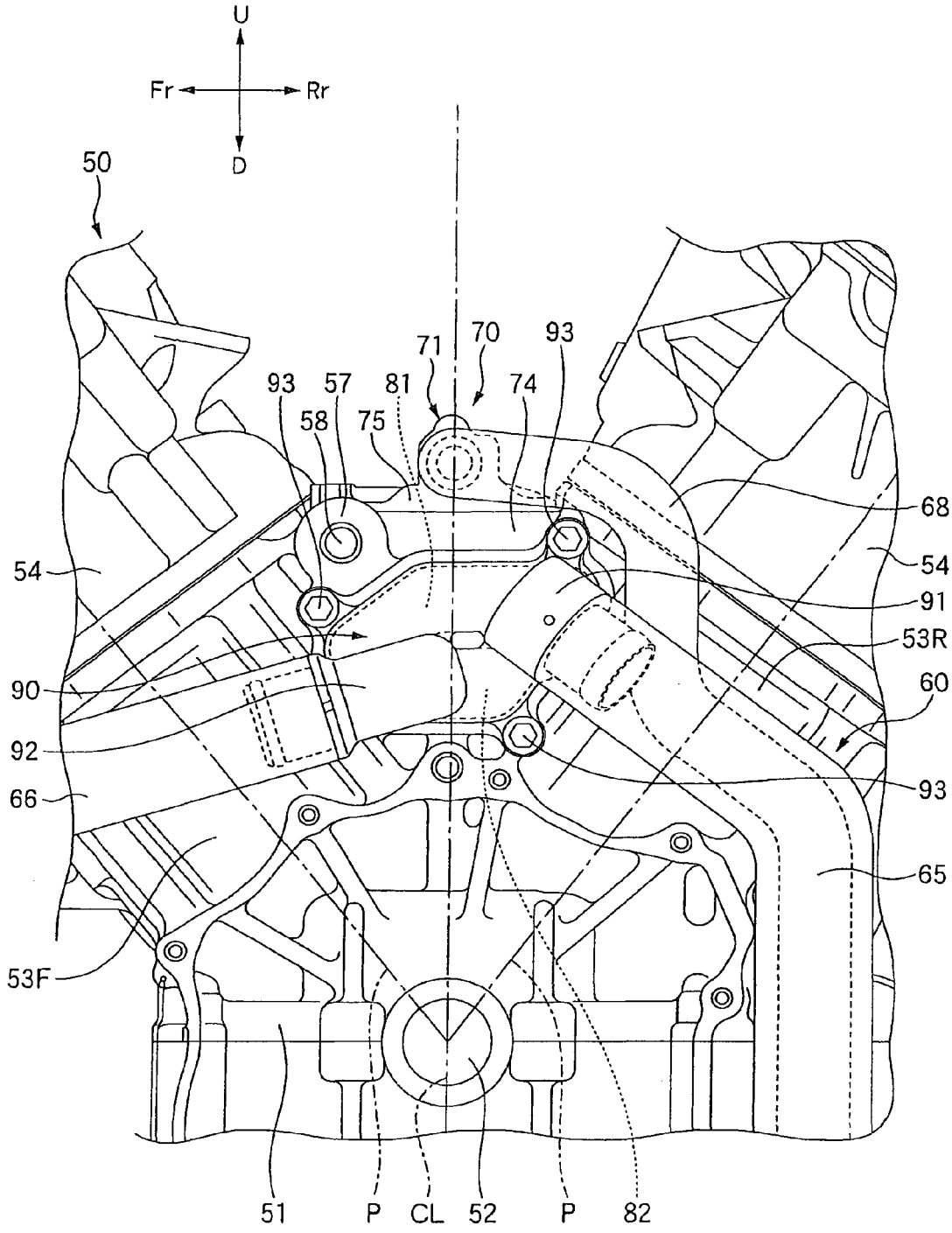
FIG. 2 is an enlarged lateral view of an essential portion for assistance in explaining the engine cooling water passage structure according to the present invention.

The engine 50 is a water-cooled V-type 4-cylinder engine and as shown in FIGS. 1 and 2 includes a crankcase 51; a front cylinder block 53F and a rear cylinder block 53R; cylinder heads 54, 54; cylinder head covers 55, 55; and a cooling device 60. The front and rear cylinder blocks 53F, 53R are formed integrally with the upper portion of the crankcase 51 to have respective cylinder axes P arranged in a V-shape centering on the crankshaft 52. The cylinder heads 54, 54 are each mounted to a corresponding one of the respective upper ends of the front and rear cylinder blocks 53F, 53R. The cylinder head covers 55, 55 each close a corresponding one of the respective upper end openings of the cylinder head covers 55, 55. The cooling device 60 is used to cool the engine 50.

With reference to FIGS. 1 and 4 to 7, the cooling device 60 mainly includes a water pump 61, a thermostat 70, water jackets 62, 63 and a radiator 64. The water pump 61 is disposed rearward of the crankshaft 52 of the crankcase 51. The thermostat 70 is disposed at the upper end of the crankcase 51 and within a V-bank of the front and rear cylinder blocks 53F, 53R. Water jackets 62, 63 are formed in the front and rear cylinder blocks 53F, 53R and in the cylinder heads 54, 54. The radiator 64 is disposed forward of the engine 50. Incidentally, reference numeral 56 in FIGS. 4 to 7 denotes a cylinder bore formed in each of the front and rear cylinder blocks 53F, 53R for the respective cylinders.

With reference to FIGS. 7 to 10, the thermostat 70 includes a thermostat case 71 disposed inside the V-bank of the front and rear cylinder blocks 53F, 53R and a thermostat valve 73 housed in a thermostat chamber 72 formed in the thermostat case 71. The thermostat case 71 includes a case body 74 formed integrally with the crankcase 51 and with the front and rear cylinder blocks 53F, 53R and a lid portion 75 adapted to close the upper end opening of the case body 74.

The thermostat valve 73 includes a wax case 73*a* which is a temperature sensor; a plunger 73*b* inserted through the wax case 73*a*; a first valve body 73*c* formed at the upper end of the plunger 73*b*; and a second valve body 73*d* formed at the lower end of the plunger 73*b*.

Figure 10:
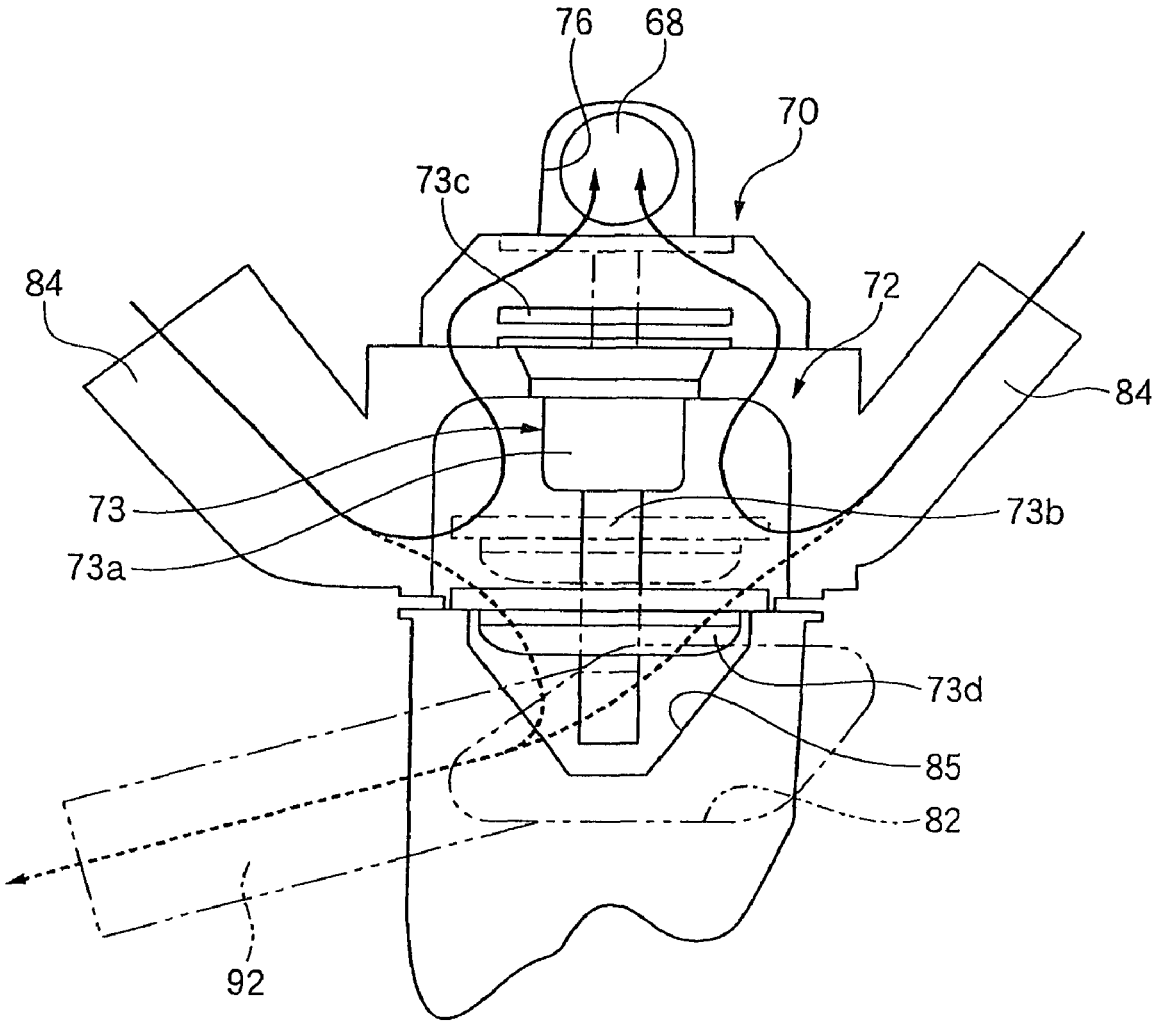
FIG. 10 is a lateral view illustrating the cooling water discharge passage, a thermostat chamber, a bypass passage connecting portion, and the cooling water outlet side connecting portion in a visualized state.

As shown in FIG. 10, the lid portion 75 is formed with a bypass passage connecting portion 76 at a position downstream of the wax case 73*a* of the thermostat valve 73, i.e., at the upper end inside the lid portion 75. The bypass passage connecting portion 76 is joined with a bypass line 68 described later.

Figure 3:
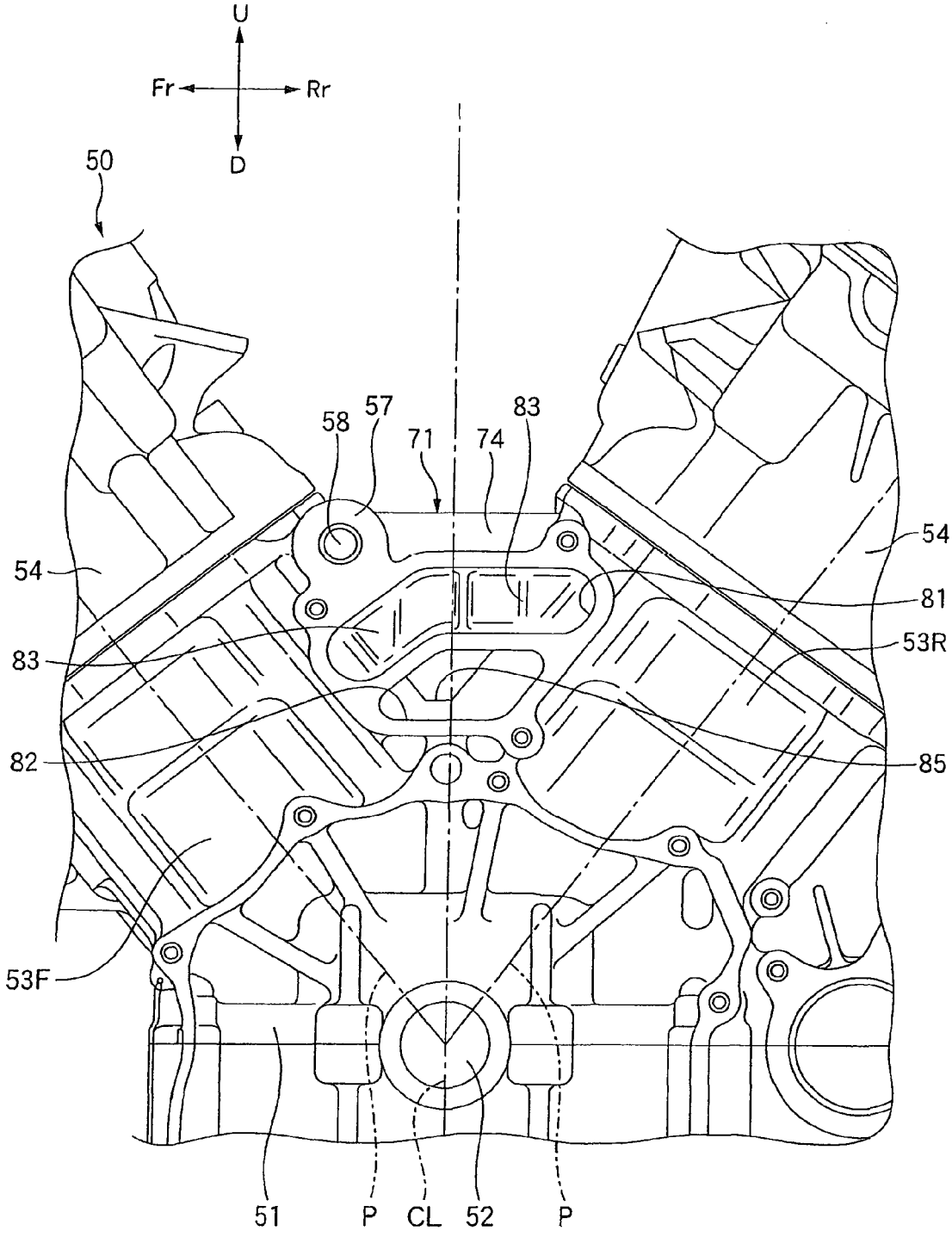
FIG. 3 is an enlarged lateral view of the essential portion with a lid portion and a connection portion cover of a thermostat case in the engine shown in FIG. 2 being removed.

As shown in FIGS. 2 and 3, in the present embodiment, a cooling water inlet side connecting portion 81 and a cooling water outlet side connecting portion 82 are provided at the upper end of the crankcase 51 and in the V-bank of the front and rear cylinder blocks 53F, 53R. The cooling water inlet side connecting portion 81 connects a cooling water supply side line 65 with a cooling water passage including the water jackets 62, 63. The cooling water outlet side connecting portion 82 connects a cooling water discharge side line 66 with a cooling water passage including the water jackets 62, 63.

As shown in FIG. 3, the cooling water inlet side connecting portion 81 and the cooling water outlet side connecting portion 82 are arranged on a centerline CL so as to align with each other as viewed from the direction of the crankshaft 52. In addition, they are formed integrally with the crankcase 51 and with the front and rear cylinder blocks 53F, 53R. The centerline CL divides the V-bank of the front and rear cylinder blocks 53F, 53R in two.

In the present embodiment, the thermostat case 71 (the thermostat 70), the cooling water inlet side connecting portion 81 and the cooling water outlet side connecting portion 82 are arranged on one side (on the left side in the embodiment) in the direction of the crankshaft 52 of the engine 50.

Figure 11:
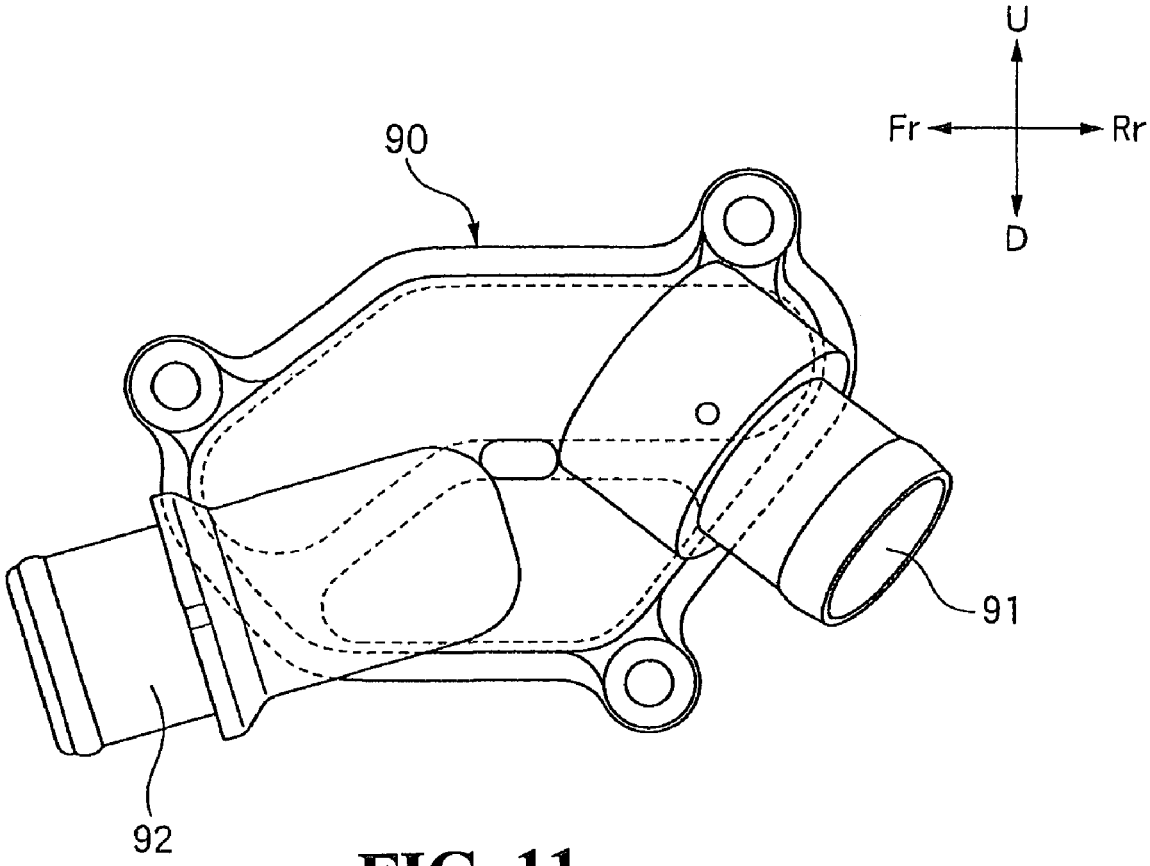
FIG. 11 illustrates the front surface of a connecting portion cover as a single piece.
Figure 12:
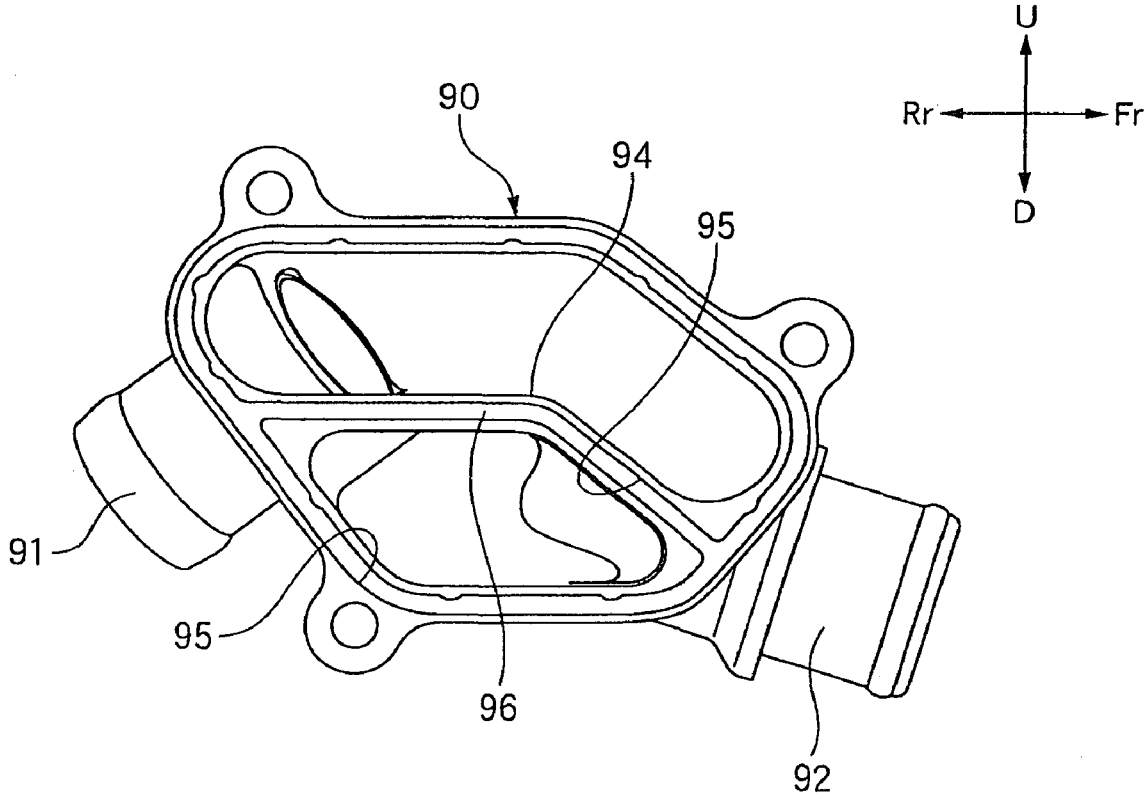
FIG. 12 illustrates the rear surface of the connecting portion cover as a single piece.

As shown in FIG. 2, the left end opening of the cooling water inlet side connecting portion 81 and of the cooling water outlet side connecting portion 82 are closed by a connecting portion cover 90. As shown in FIGS. 11 and 12, this connection portion cover 90 is formed with a supply port 91 and with a discharge port 92. The supply port 91 is adapted to communicate with the cooling water inlet side connecting portion 81 and connect with the cooling water supply side line 65. The discharge port 92 is adapted to communicate with a cooling water outlet side connecting portion 82 and connect with a cooling water discharge side line 66. The connecting portion cover 90 is fastened to the engine 50 with three hexagon bolts 93. In addition, the connecting portion cover 90 is formed on a rear surface with a partition wall 94 separating the cooling water inlet side connecting portion 81 from the cooling water outlet side connecting portion 82. The connecting portion cover 90 is formed on a rear surface with a groove portion 95 extending along the outer circumferential edge portions and along the partition wall 95. A packing 96 is fitted into the groove portion 95.

As shown in FIGS. 1 and 2, the cooling water supply side line 65 has one end connected to the discharge port of the water pump 61 and the other end connected to the supply port 91 of the connection portion cover 90. The cooling water discharge side line 66 has one end connected to the discharge port 92 of the connecting portion cover 90 and the other end connected to the inflow port of the radiator 64. One end of a cooling water return side line 67 is connected to the outflow port of the radiator 64 and the other end is connected to the suction port of the water pump 61.

In the present embodiment, one end of the bypass pipe 68 is connected to one end of the thermostat case 71 on the side separate from the crankshaft 52, i.e., to the upper end of the lid portion 75 of the thermostat case 71. The other end of the bypass pipe 68 extends toward the one end side (on the left end side in the present embodiment) of the engine 50 in the direction of the crankshaft 52 and is connected to the water pump 61.

As shown in FIGS. 4 to 8, in the present embodiment, cooling water supply passages 83, 83, cooling water discharge passages 84, 84, and a cooling water outflow passage 85 are provided at the upper end of the crankcase 51 and in the V-bank of the front and rear cylinder blocks 53F, 53R. The cooling water supply passages 83, 83 is adapted to supply cooling water from the cooling water inlet side connecting portion 81 to the water jackets 62, 63 on both the bank sides. The cooling water discharge passages 84, 84 are adapted to discharge cooling water from the water jackets 62, 63 on both the bank sides into the thermostat case 71. The cooling water outflow passage 85 is adapted to allow cooling water to flow from the thermostat case 71 to the cooling water outlet side connecting portion 82.

Figure 4:
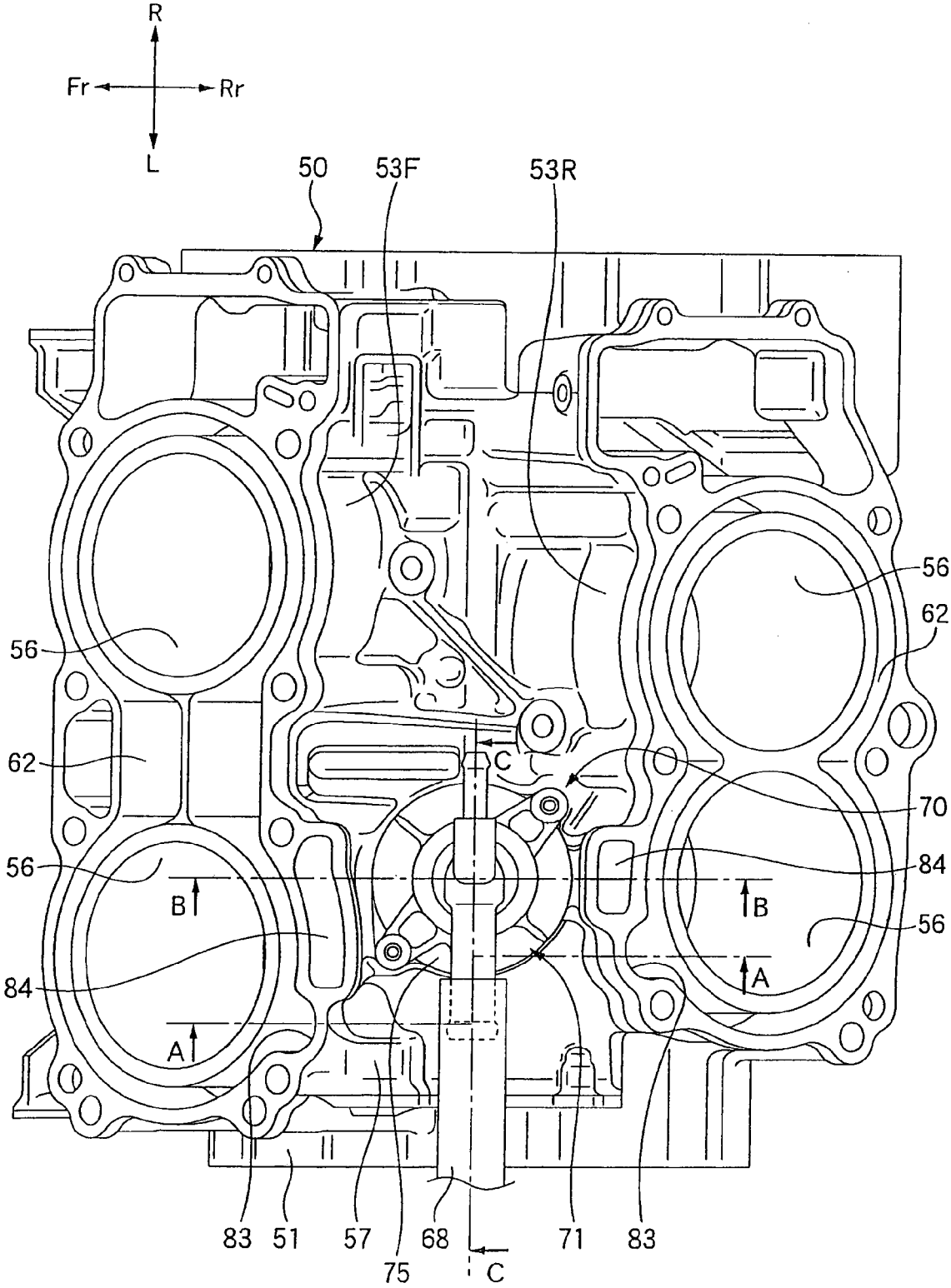
FIG. 4 is an enlarged plan view of the essential portion of the engine shown in FIG. 2.
Figure 5:
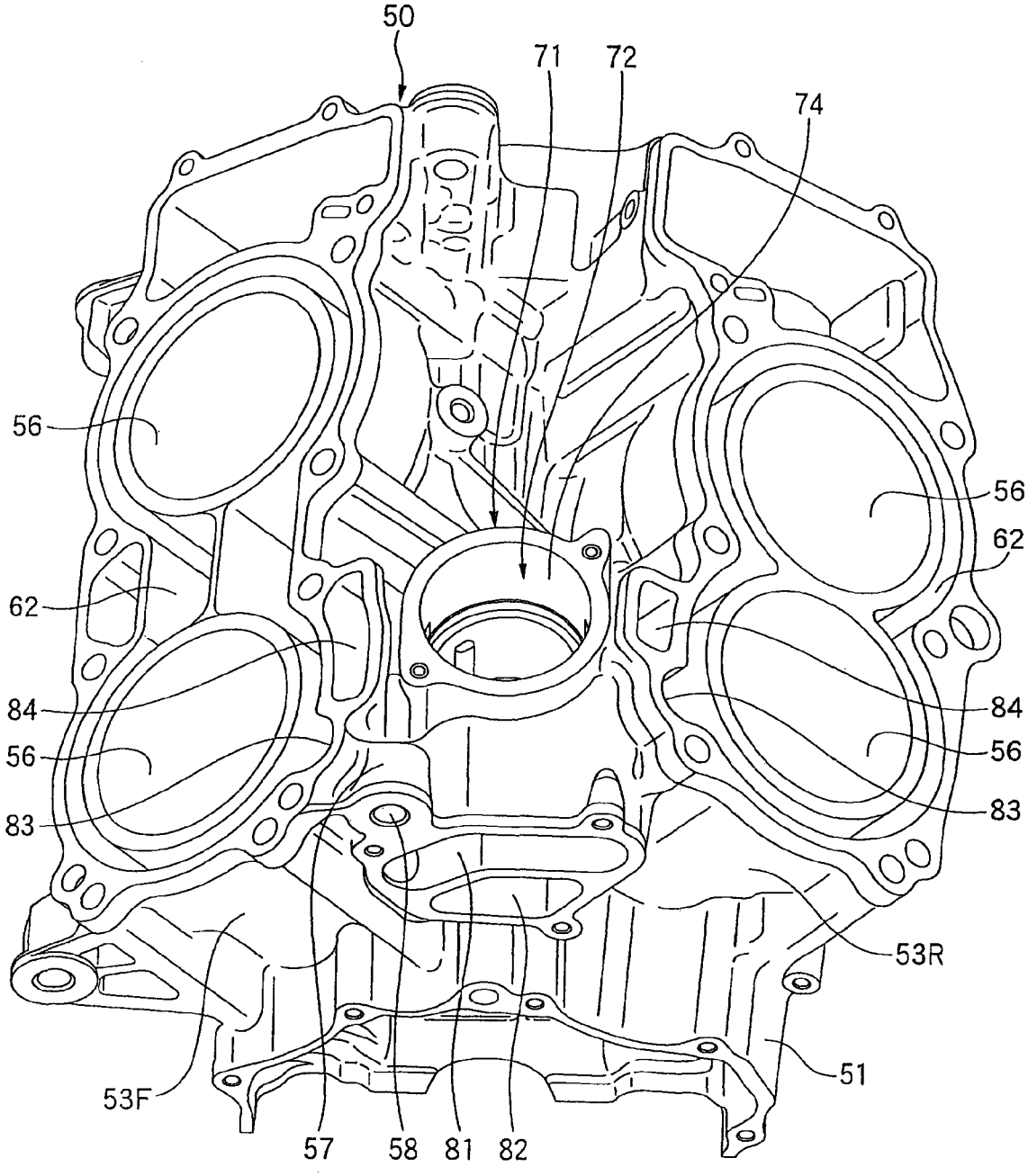
FIG. 5 is a perspective view of the cylinder block shown in FIG. 2 with a cylinder head removed.
Figure 6:
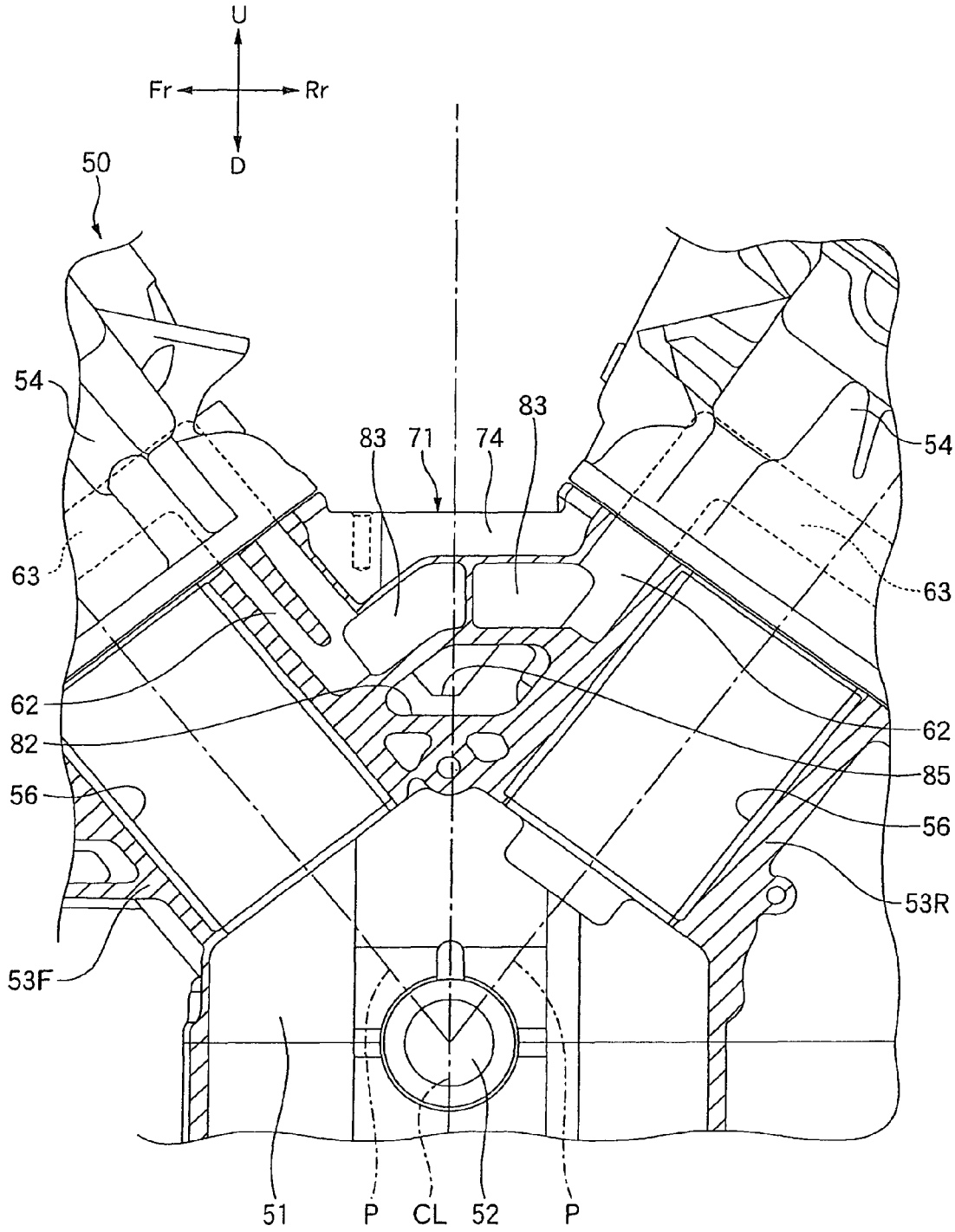
FIG. 6 is a cross-sectional view taken along line A-A of FIG. 4.
Figure 7:
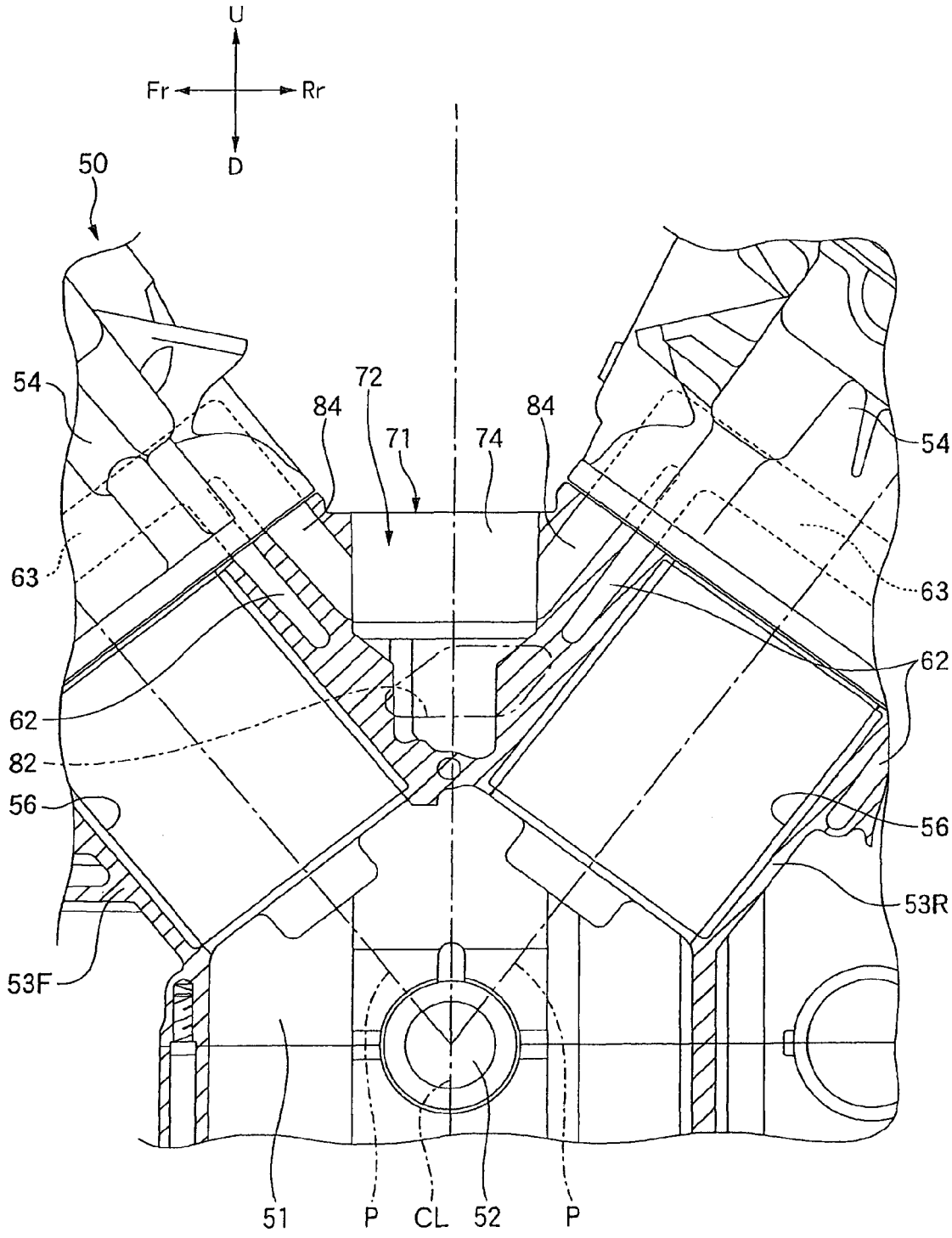
FIG. 7 is a cross-sectional view taken along line B-B of FIG. 4.
Figure 8:
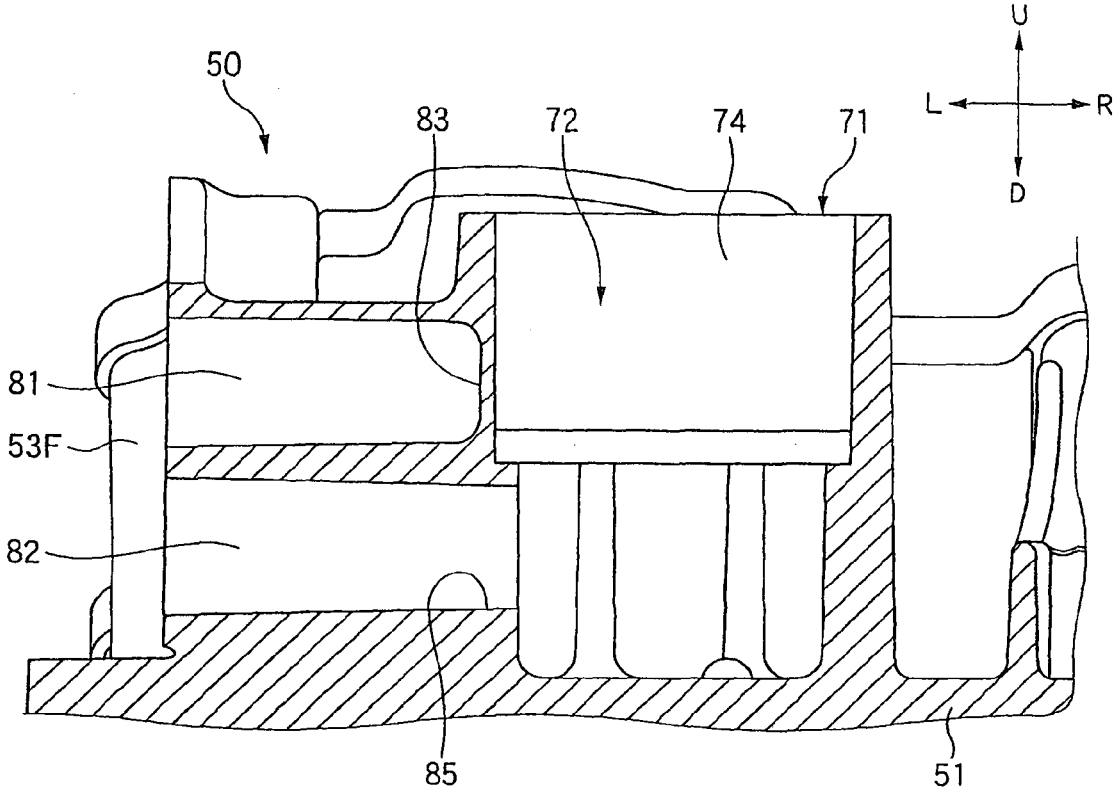
FIG. 8 is a cross-sectional view taken along line C-C of FIG. 4.
Figure 9:
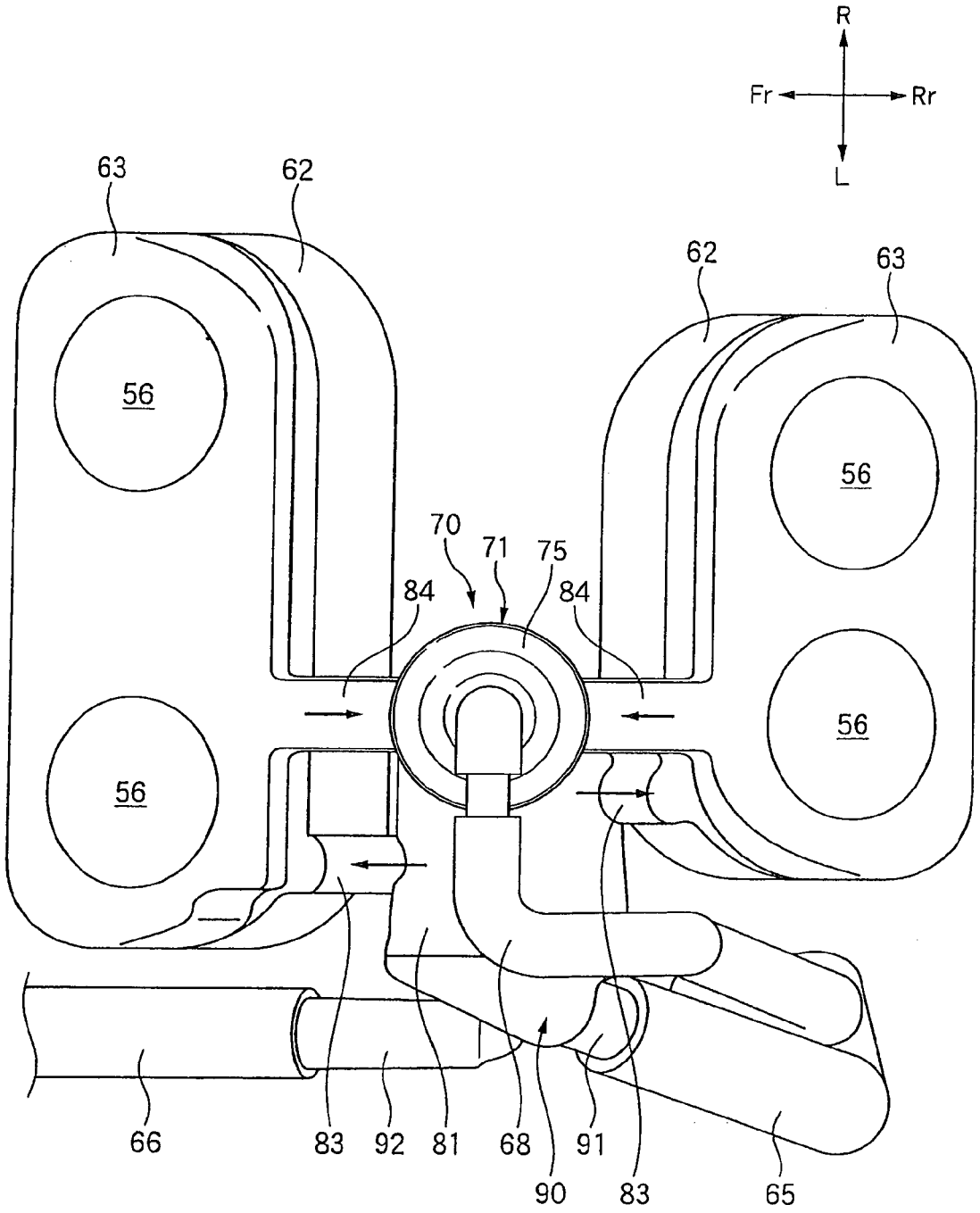
FIG. 9 is a plan view illustrating a cooling water inlet side connecting portion, a cooling water supply passage, water jackets, cooling water discharge passages, and a cooling water outlet side connecting portion in a visualized state.

As shown in FIGS. 4 and 7, in the present embodiment, the cooling water discharge passages 84 are each formed in a corresponding one of the front and rear cylinder blocks 53F, 53R to extend in the direction perpendicular to the crankshaft 52. The cooling water discharge passages 84 and the thermostat case 71 are arranged to align with each other in the direction perpendicular to the crankshaft 52. Thus, the front and rear cylinder blocks 53F, 53R are connected to each other in the back and forth direction of the vehicle by the cooling water discharge passage 84 and by the thermostat case 71, thereby increasing the rigidity of the front and rear cylinder blocks 53F, 53R.

As shown in FIGS. 2 to 5, in the present embodiment, the cooling water supply passage 83 on the front bank side is provided such that the front cylinder block 53F is formed with a protrusion 57. The protrusion 57 is formed with an engine hanger 58 used to secure the engine 50 to the main frames 12.

As shown in FIGS. 7 and 10, in the present embodiment, the cooling water discharge passages 84, 84 are formed in a V-shape as viewed from the direction of the crankshaft 52. In addition, the thermostat case 71 is disposed at the central portion of the V-shape. The wax case 73*a* of the thermostat valve 73 is disposed in the V-bank formed by the cooling water discharge passages 84, 84 and the bypass passage connecting portion 76 is formed on the downstream side of the wax case 73*a*. In this way, the wax case 73*a* is disposed near a position where the direction of the flow of the cooling water flowing in the thermostat chamber 72 is turned down during warm-up operation. Thus, the temperature of the cooling water can efficiently be transmitted to the wax case 73*a*, thereby enhancing the response of the wax case 73*a*.

In the present embodiment, as shown in FIGS. 7 and 10, the cooling water outlet side connecting portion 82 is formed in the vicinity of the top of the V-bank formed by the cooling water discharge passages 84, 84. Even at the time of completing the warm-up operation, this allows the cooling water flowing into the thermostat chamber 72 in the V-shape to be led to the cooling water outlet side connecting portion 82 in the form conforming to the direction of the flow. Thus, pressure loss is reduced to improve the efficiency of the water pump 61.

In the engine cooling water passage structure configured as above, as shown in FIGS. 1 through 9, the cooling water inlet side connecting portion 81 connected with the cooling water supply side line 65, the cooling water supply passages 83, 83 connecting the cooling water inlet side connecting portion 81 with both the water jackets 62, 63 on both the bank sides, the cooling water discharge passages 84, 84 connecting both the bank side water jackets 62, 63 with the thermostat case 71, the case body 74 of the thermostat case 71, the cooling water outflow passage 85 connecting the thermostat case 71 with the cooling water outlet side connecting portion 82, the cooling water outlet side connecting portion 82 connected with the cooling water discharge side line 66 are disposed inside the V-bank of the front and rear cylinder block 53F, 53R and formed integrally with the crankcase 51 and with the front and rear cylinder blocks 53F, 53R.

In this way, during warm-up operation, since the first valve body 73*c* of the thermostat valve 73 is opened and the second valve body 73*d* is closed (see the solid lines in FIG. 10), the cooling water discharged from the water pump 61 is circulated in the following order: the cooling water supply side line 65→the cooling water inlet side connecting portion 81→the cooling water supply passages 83, 83→the water jackets 62, 63 on both the bank sides→the cooling water discharge passages 84, 84→the thermostat chamber 72→the bypass passage connecting portion 76→the bypass line 68→the water pump 61. At the time of completing the warm-up operation, since the first valve body 73*c* of the thermostat valve 73 is closed and the second valve body 73*d* is opened (see the chain lines in FIG. 10), the cooling water is circulated in the following order: the cooling water supply side line 65→the cooling water inlet side connecting portion 81→the cooling water supply passages 83, 83→the water jackets 62, 63 on both the bank sides→the cooling water discharge passages 84, 84→the thermostat chamber 72→the cooling water outflow passage 85→the cooling water outlet side connecting portion 82→the cooling water discharge side line 66→the radiator 64→the cooling water return side line 67→the water pump 61.

As described above, according to the engine cooling water passage structure of the present embodiment, the thermostat case 71, the cooling water inlet side connecting portion 81 and the cooling water outlet side connecting portion 82 are disposed on one side of the engine 50 in the direction of the crankshaft 52. Therefore, the cooling water line is not arranged to extend in the narrow space within the V-bank. Thus, the cooling water passage structure can be simplified to enhance the productivity of the engine. In addition, a space adapted to arrange auxiliary machines therein can be ensured in the V-bank.

According to the engine cooling water passage structure, the cooling water inlet side connecting portion 81 and the cooling water outlet side connecting portion 82 are arranged to align with each other on the centerline CL as viewed from the direction of the crankshaft 52, the centerline CL dividing the V-bank of the front and rear cylinder blocks 53F, 53R in two. The V-bank shape of the front and rear cylinder blocks 53F, 53R can effectively be utilized. Thus, the engine 50 can be made compact.

The engine cooling water passage structure of the present embodiment is provided with the cooling water discharge passages 84, 84 each adapted to discharge cooling water from a corresponding one of the water jackets 62, 63 to the thermostat case 71. The cooling water discharge passages 84, 84 are each formed in a corresponding one of the front and rear cylinder blocks 53F, 53R so as to extend along the direction perpendicular to the crankshaft 52. The cooling water discharge passages 84, 84 and the thermostat case 71 are arranged to align with each other in the direction perpendicular to the crankshaft 52. The partition wall between one of the cooling water discharge passages 84, 84 and the thermostat case 71 and between the other cooling water discharge passage and the thermostat case 71 can be shared with each other. Thus, the thickness of the partition wall can be reduced compared with the case where the partition wall is individually formed, thereby reducing the weight of the engine 50. In addition, the cooling water discharge passages 84, 84 and the thermostat case 71 are formed to connect the V-arranged front and rear cylinder blocks 53F, 53R with each other in the back and forth direction of the vehicle. Thus, the rigidity of the front and rear cylinder blocks 53F, 53R can be increased.

According to the engine cooling water passage structure of the present embodiment is provided with the bypass line 68 connected to the end of the thermostat case 71 on the side separate from the crankshaft 52. The bypass line 68 extends toward one end of the engine 50 in the direction of the crankshaft 52 and connects with the water pump 61. All the cooling water lines 65, 66, 67, 68 can be put together on one side of the engine 50. Thus, the cooling lines 65, 66, 67, 68 can easily be checked. In addition, the space within the V-bank can be ensured.

The engine cooling water passage structure of the present embodiment is provided with the cooling water supply passages 83, 83 adapted to supply cooling water from the cooling water inlet side connecting portion 81 to the water jackets 62, 63. The cooling water supply passage 83 is provided to form the protrusion 57 on the front cylinder block 53F. The protrusion 57 is formed with the engine hanger 58 used to secure the engine 50 to the main frames 12. Thus, the protrusion 57 can effectively be utilized to form the engine hanger 58, thereby reducing the weight of the engine 50.

According to the engine cooling water passage structure of the present embodiment, during warm-up operation, the cooling water flowing toward the bypass line flows through the wax case 73*a*, and the wax case 73*a* is disposed near a position where the direction of the flow of the cooling water from the water jackets 62, 63 is changed. Thus, the temperature of the cooling water can efficiently be transmitted to the wax case 73*a*, thereby enhancing the response of the wax case 73*a*. At the time of completing the warm-up operation, the cooling water increased in flow rate after the warm-up operation can be led to the cooling water outlet side connecting portion 82 in the form conforming to the direction of the flow thereof, because the cooling water outlet side connecting portion 82 is formed in the vicinity of the top of the V-bank formed by the cooling water discharge passages 84, 84. Thus, pressure loss is reduced to improve the efficiency of the water pump 61.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. A cooling water passage structure for an engine, comprising:

an engine having cylinder axes arranged in a V-shape centering on a crankshaft;

water jackets formed in respective cylinder blocks and respective cylinder heads of said engine;

a thermostat case having a portion formed integrally with said cylinder blocks in a V-bank of said cylinder blocks;

a cooling water inlet side connecting portion connecting a cooling water supply side line with a cooling water passage including said water jackets; and a cooling water outlet side connecting portion connecting a cooling water discharge side line with said cooling water passage including said water jackets;

wherein said thermostat case, said cooling water inlet side connecting portion, and said cooling water outlet side connecting portion are disposed on one side of said engine with respect to the axial direction of said crankshaft, wherein said cooling water inlet side connecting portion and said cooling water outlet side connecting portion are arranged on a centerline to align with each other as viewed from the axial direction of said crankshaft, and wherein the centerline divides the V-bank of said cylinder blocks in two.

2. The cooling water passage structure for an engine according to claim 1, further comprising:

a cooling water discharge passage adapted to discharge cooling water from said water jackets to said thermostat case;

wherein said cooling water discharge passage is formed in said cylinder heads to extend in a direction perpendicular to said crankshaft, and wherein said cooling water discharge passage and said thermostat case are arranged in a direction perpendicular to said crankshaft so as to align with each other.

3. The cooling water passage structure for an engine according to claim 1, further comprising:

a bypass line connected to an end of said thermostat case opposite said crankshaft, with respect to said thermostat case;

wherein said bypass line extends toward one side of said engine with respect to the axial direction of said crankshaft, and connects with a water pump.

4. The cooling water passage structure for an engine according to claim 1, further comprising:

a cooling water supply passage adapted to supply cooling water from said cooling water inlet side connecting portion to said water jackets;

wherein said cooling water supply passage forms a protrusion on said cylinder block, and wherein said protrusion includes an engine hanger used to secure said engine to a body frame.

5. The cooling water passage structure for an engine, according to claim 1, wherein a cooling water discharge passage is formed in a V-shape as viewed from the direction of said crankshaft and said thermostat case is disposed at a central portion of the V-shape, wherein a temperature sensor constituting a thermostat is disposed in the V-bank formed by said cooling water discharge passage, wherein a bypass passage connecting portion adapted to supply cooling water from said thermostat to a cooling water bypass passage is formed on said downstream side of said temperature sensor, and wherein a cooling water outlet side connecting portion is formed in the vicinity of the top of the V-bank formed by said cooling water discharge passage.

* * * * *